US010458257B2

(12) United States Patent
Nucci et al.

(10) Patent No.: US 10,458,257 B2
(45) Date of Patent: Oct. 29, 2019

(54) BLADE COMPRISING A SHANK, PROVIDED WITH A DEPRESSED PORTION

(71) Applicant: SAFRAN AIRCRAFT ENGINES, Paris (FR)

(72) Inventors: Marco Nucci, Toulouse (FR); Damien Merlot, Vaux le Penil (FR); Jacky Rodriguez, Bezons (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 109 days.

(21) Appl. No.: 15/872,782

(22) Filed: Jan. 16, 2018

(65) Prior Publication Data

US 2018/0156047 A1 Jun. 7, 2018

Related U.S. Application Data

(63) Continuation-in-part of application No. 14/579,426, filed on Dec. 22, 2014, now abandoned.

(30) Foreign Application Priority Data

Dec. 23, 2013 (FR) ..... 13 63374

(51) Int. Cl.
*F01D 5/30* (2006.01)
*F01D 5/14* (2006.01)
*F01D 5/16* (2006.01)

(52) U.S. Cl.
CPC ..... *F01D 5/3007* (2013.01); *F01D 5/141* (2013.01); *F01D 5/16* (2013.01);
(Continued)

(58) Field of Classification Search
CPC ..... F01D 5/3007; F01D 5/141; F01D 5/16; F01D 5/30; F05D 2250/294; F05D 2260/941; F05D 2220/3217; F05D 2250/71; F05D 2240/12; F05D 2250/11; F05D 2260/96; F05D 2250/13
See application file for complete search history.

(56) References Cited

U.S. PATENT DOCUMENTS 3,873,234 A * 3/1975 Penny ..... F01D 5/021 416/97 R
4,595,340 A 6/1986 Klassen
(Continued)

FOREIGN PATENT DOCUMENTS

| | | |
|---|---|---|
| EP | 2 110 513 A | 10/2009 |
| FR | 2 997 723 A1 | 5/2014 |
| GB | 2 162 588 A | 2/1986 |

OTHER PUBLICATIONS

French Preliminary Search Report dated Aug. 21, 2014, in French Application No. 13 63374 filed Dec. 23, 2013 (with English Translation of Categories of Cited Documents).

*Primary Examiner* — Eldon T Brockman
(74) *Attorney, Agent, or Firm* — Oblon, McClelland, Maier & Neustadt, L.L.P.

(57) ABSTRACT

The shank of a blade includes a first side and a second side provided with a depression. By concentrating this depression on a single side, a shank that is more rigid and resistant with an equal lightening is obtained, with the stress concentrations depending on the depth of the depression but being absent from first flat side. The vibrations and bending deformations are also reduced.

12 Claims, 2 Drawing Sheets

(52) U.S. Cl.
CPC .. *F05D 2220/3217* (2013.01); *F05D 2240/12* (2013.01); *F05D 2250/11* (2013.01); *F05D 2250/13* (2013.01); *F05D 2250/294* (2013.01); *F05D 2250/71* (2013.01); *F05D 2260/941* (2013.01); *F05D 2260/96* (2013.01)

(56) References Cited

U.S. PATENT DOCUMENTS

| | | | | |
|---|---|---|---|---|
| 4,940,389 | A | 7/1990 | Luxenburger | |
| 5,261,790 | A | 11/1993 | Dietz | |
| 5,435,694 | A * | 7/1995 | Kray | F01D 5/141 416/219 R |
| 8,727,730 | B2 | 5/2014 | Liotta | |
| 9,140,132 | B2 * | 9/2015 | Faulder | F01D 5/147 |
| 9,353,629 | B2 | 5/2016 | Faulder | |
| 9,359,905 | B2 | 6/2016 | Lamicq | |
| 2013/0224036 | A1 | 8/2013 | Lamicq | |
| 2013/0319008 | A1 | 12/2013 | Faulder | |
| 2014/0150454 | A1 | 6/2014 | Faulder | |

* cited by examiner

BLADE COMPRISING A SHANK, PROVIDED WITH A DEPRESSED PORTION

CROSS-REFERENCE TO RELATED APPLICATIONS

This application is a continuation-in-part application of U.S. application Ser. No. 14/579,426 filed Dec. 22, 2014, which claims priority to France Application No. 13 63374 filed Dec. 23, 2013. U.S. application Ser. No. 14/579,426 is herein incorporated by reference in its entirety for all purposes.

DESCRIPTION

This invention relates to a blade comprising a shank provided with a depressed portion on a single side.

This blade, which can be a turbomachine compressor blade, comprises an outside vane subjected to aerodynamic forces, and a foot retained in a rotating disc; the foot comprises a platform flush with the surface of the disc and from which the vane rises, a bulb retaining the blade against the centrifugal forces and retained in an enlargement of a groove of the disc, and a shank joining the bulb to the platform, and housed in a main portion of the groove.

Portions with a depression have sometimes been dug into the main or lateral faces of the shank so as to lighten the blade. Disadvantages, such as local increases in the static stresses and an alteration in the frequency of the bending modes, have however been observed with respect to blades of which the shanks are devoid of a depression.

In French patent application 12 60527, it was undertaken to reduce these disadvantages and to bring the behaviour of the blade provided with portions with a depression closer to that of a blade with perfectly flat shanks, by choosing dissymmetric portions with a depression, in particular with regards to the depth. This application clearly specifies that the portions with a depression are established on the two main sides of the shank.

Document U.S. Pat. No. 5,435,694 A describes a blade wherein the shank is joined to the platform or to the bulb by fillets, which are mouldings with a slightly concave section, in order to reduce the stress that the blade in service is subjected to. Portions slightly with a depression are added in order to reinforce this effect, by decreasing the concentrations of stress around the fillets. These portions with a depression are defined by two successive radii of curvature and are superficial. They are much smaller in height (they extend only in a part of the shank height between the platform and the bulb) than in the length direction of the shank. It is not sought to lighten the blade by means of these portions with a depression or by fillets, which are shallow, but only to relieve stress concentrations.

GB 2 162 588 A describes a blade shank provided with a recess that opens onto one of the end faces of the shank in order to lighten it. This design is suitable for relatively thick shanks. The structure of the shank remains symmetrical in the angular direction on either side of a median plane extending in the length of the shank.

The invention relates to a lightened blade, designed to minimise the degradations in aeromechanical performance, in particular concerning the concentrations of stress and the frequency of the bending modes.

According to the invention, one of the main faces of the shank is substantially plane or curvilinear—in any case with a regular surface without relief—while the other of the main faces is provided with a depressed portion, extending over a depth of at least 25%, and advantageously by at least 35%, of a thickness of the shank, between the main faces. It is specified that the main faces of the shank—which extends roughly in the axial direction of the disc and of the turbomachine to which the blade belongs—are the lateral faces with the largest surface area, roughly perpendicular to the angular direction of the disc and of the machine, giving onto the intrados and extrados sides of the blade, and extending in the length direction of the foot of the blade, which corresponds to its direction of insertion into the cutout of the disc, and in the height direction of the foot, which corresponds to the radial direction of the blade in the machine, from the foot to the tip of the vane. And the depressed portion is limited by two main sides, respectively parallel to junction lines of the shank to the bulb and to the platform, said main sides being separated, along each line in the height direction of the blade crossing said main sides, by at least 50% of a distance separating said junction lines.

Unlike in U.S. Pat. No. 5,435,694 A, the greatest possible area and a greater depth are allotted to the depressed portion in order to obtain an important lightening. But this lightening should not entail a loss of mechanical characteristics, especially stiffness to vibrations and resistance to shocks produced by ingestion of solid bodies, compared to blades having a foot with a uniform cross-section and a regular shape. A satisfactory result in these aspects has been stated with the blade feet of the invention, which have a dissymmetric cross-section, since the depressed portion is provided on one face only, the other face remaining smooth: this other face maintains the resistance and stiffness qualities of the blade almost completely, even when an important lightening has been obtained after the opposite face has been hollowed. Depressed portions symmetrically arranged in both main faces would not maintain these characteristics well, nor would a general thickness reduction of the shank. For the same reasons, the inventive depressed portion does not extend to the free ends of the foot (in the length direction thereof), and it is normally defined by a closed, continuous outline.

The degradation in the performance obtained on the blade is then clearly less substantial than with portions with a depression distributed symmetrically on the two sides of the shank, or even than with the portions with a depression opposite and moderately dissymmetric considered in application FR 12 60527. And GB 2 162 588 does not suggest that a dissymmetric shank in the angular direction would improve the rigidity of the shank in the same direction wherein the bending of the blade is exerted.

Indeed, flatness maintained on one of the main faces increases the rigidity of the blade with regards to the deformations in bending and prevents the introduction of concentrations of stress on one side: it can therefore be considered to arrange the depression on the side where the concentrations of stress are the least feared, i.e. the side that is the least loaded in the critical situations to be considered, such as the loss of a blade, in order to obtain a globally satisfactory distribution over the blade by not weakening the other side.

According to other optional improvements, the depressed portion has a bottom that is substantially flat or curvilinear (parallel to the main face, and therefore at a uniform depth), surrounded by a curved edge, connecting to the bottom without forming an angle, in order to obtain a good lightening without favouring concentrations of stress at the edge of the portion; and it is advantageously limited by rectilinear sides joined by curvilinear transitions.

The dimensioning of the depressed portion can also comply with certain general rules, pursuant to the principle mentioned above that the area is advantageously as great as possible for obtaining a great lightening. The height of the depressed portion (in the height direction of the foot, or radial direction of the blade) is thus not limited to the 50% value of the distance between the junction lines of the shank to the bulb and the platform; contrarily, it is advantageous that this height be superior, e. g. at least 66% of this distance.

Similarly, a great span of the depressed portion in the length direction of the foot (between the free ends) is sought. If this is possible, the depressed portion can extend from 30% to 80% (typically at least 40% or 50% in ordinary blade designs) of the distance between the opposite edges, at the free ends, of the main face on which it is provided.

This arrangement is not always practicable, however, in situations in which the shank height steeply varies along the feet and may become too low near an end to receive the depression. The situation may arise e. g. for blades at the entrance of compressors, which is a place where one can favourably consider to insert the inventive blades. In a typical design, the depressed portion is limited by only three sides then, i. e. the two main sides already mentioned, which are linked with a curved transition having a constant radius of curvature, and a third side, parallel to a free edge of the face. Even then, the span of the depressed portion in the length direction of the foot is advantageously as great as possible.

To synthesize the foregoing rules, one may remember that the depressed portion advantageously has, in the height direction, a maximal dimension which is superior to at least 0.67 times a maximal dimension in the perpendicular direction, or length direction, of the foot; and the depth of the depression is at least 25%, and more preferably 35%, of the shank thickness.

It is contemplated that the shank will connect the bulb with a transition having a constant radius, and junctions to the shank and the bulb respectively tangent thereto so that no recess is present at this connection between the bulb and the shank.

The invention shall now be described in liaison with the following figures.

Figure 5:
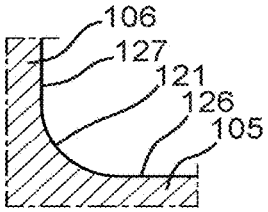

and FIG. 5 illustrates the connection of the shank to the bulb.

Figure 1:
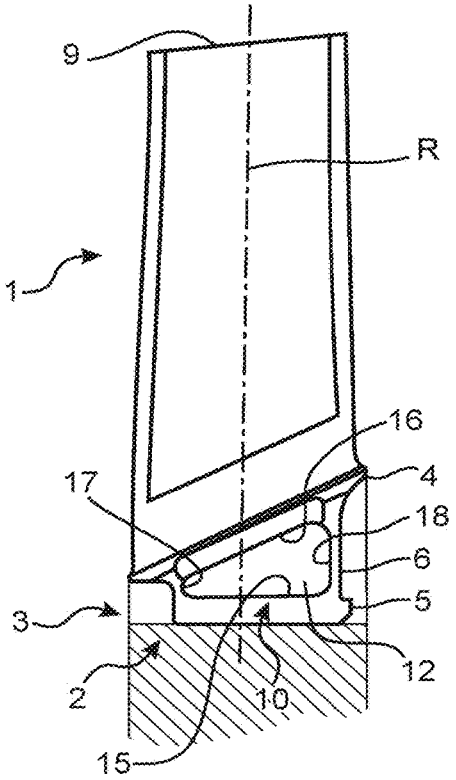
FIG. 1 is a general view of the blade in the angular direction.

FIG. 1 shows a blade in accordance with the invention, provided with a vane 1 to the exterior and with a foot 2 engaged in the rotating disc 3, with the foot 2 comprising a platform 4 joined to the vane 1, a bulb 5 opposite the platform 4, and a shank 6, joining the two latter items. As the platform 4 is conical, the shank 6 is trapezoidal. A tip edge of the vane 1 is referred to by 9, and a height direction R of the blade extends from the bulb 5 to the tip edge 9.

Figure 2:
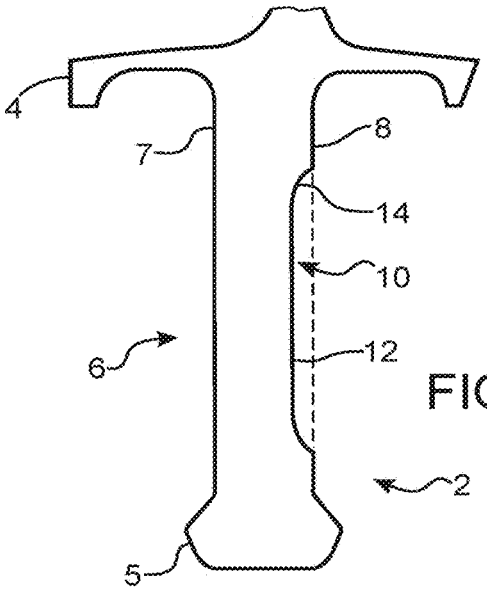
FIG. 2 is a view of the foot of the blade in the axial direction.

The shank 6 comprises two main faces 7 and 8 opposite, shown in FIG. 2, giving onto the pressure side and suction sides of the blade and extending roughly in the direction of the axis of rotation of the disc 3. The main face 7 is flat (smooth, with a linear or curvilinear extension), but the main face 8 is provided with a depressed portion 10, taking a flat bottom 12 and an edge 14 connecting the bottom 12 to the main face 8. The edge 14 is connected to the bottom 12 without forming any sharp angle, but with a progressive rounding. The depressed portion 10 is of trapezoidal shape, as shown in FIG. 1, with a first longitudinal side 15, close to the bulb 5 and parallel to its junction with the shank 6, a second longitudinal side 16 close to the platform 4 and parallel to the connection between it and the shank 6, and two other sides 17 and 18, connecting the latter together and curvilinear at least at the ends.

The depressed portion 10 can be present according to case on the pressure side or the suction side of the blade.

By making use of a depression on a single side of the shank 6, the gain in mass is provided while still minimising the effect on the aerodynamic and mechanical behaviour of the blade: the static stress, the position of the first bending mode and the response of the first bending mode under substantial stress, are improved with respect to a blade comprising, for the same lightening, portions with a depression on the two sides.

In relation to such a blade comprising two portions with a depression, it has been observed, in a design in accordance with the invention, wherein the thickness of the shank 6 (distance between the two main faces 7 and 8) was 15.4 mm and the depressed portion had a depth of 5.7 mm, a static stress at the output of the blade, on its contact surfaces with the disc 3, reduced by 5% in the most loaded zone with respect to a blade having depressions on the two sides and a similar lightening; and for a first bending mode, the deformations measured in the shank 6 were reduced by 30% following substantial stress such as floating (instability due to the interaction of the fluid with the structure of the vanes 1 which has for effect to amplify the vibration of the blades), ingestions of foreign bodies or the loss of a vane 1.

It is therefore possible to hope for a better resistance, or a longer resistance in the case of fatigue, of the foot 2, and better resistance of the vanes 1 with regards to vibrations. It is to be added that the frequency of the bending mode is not modified by the concentration of the lightening of a single side, in such a way that the invention does not require having to again optimise the blade with regards to these frequencies, once the optimisation has been carried out for blades with shanks recessed on the two sides.

The same considerations apply to blade shanks of which the main faces would be curvilinear instead of being flat: the depressed portion would again be located on only one of its main faces and would be dimensioned in the same way.

Figure 3:
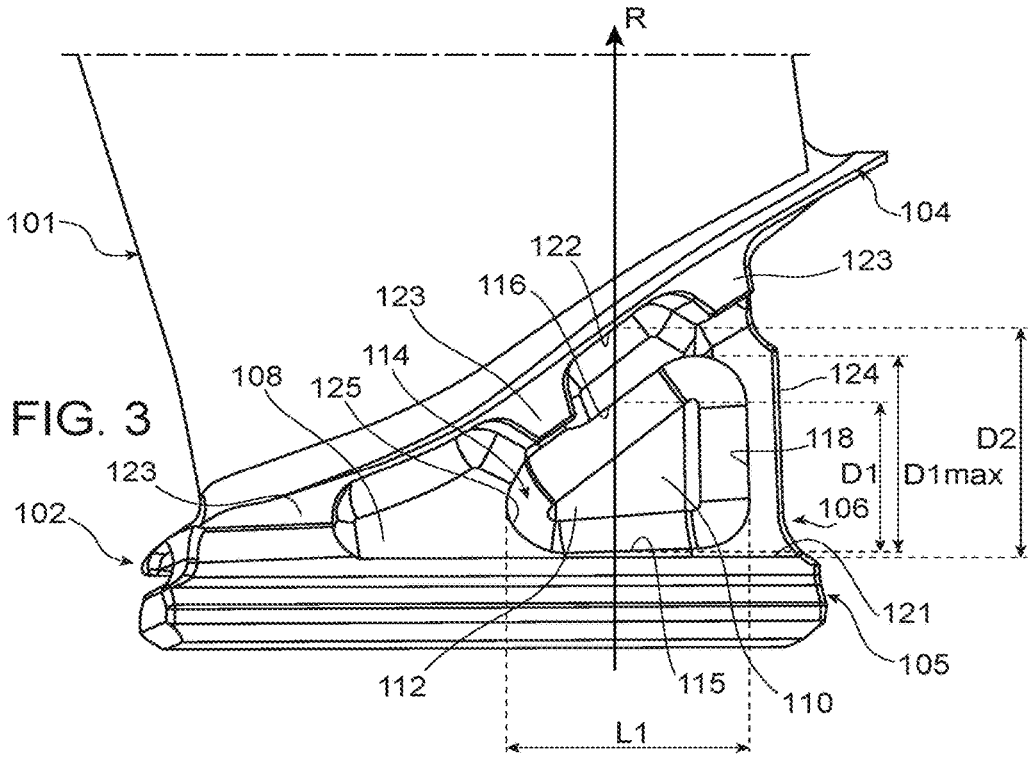
FIGS. 3 and 4 illustrate a particularly preferred embodiment of the invention.
Figure 4:
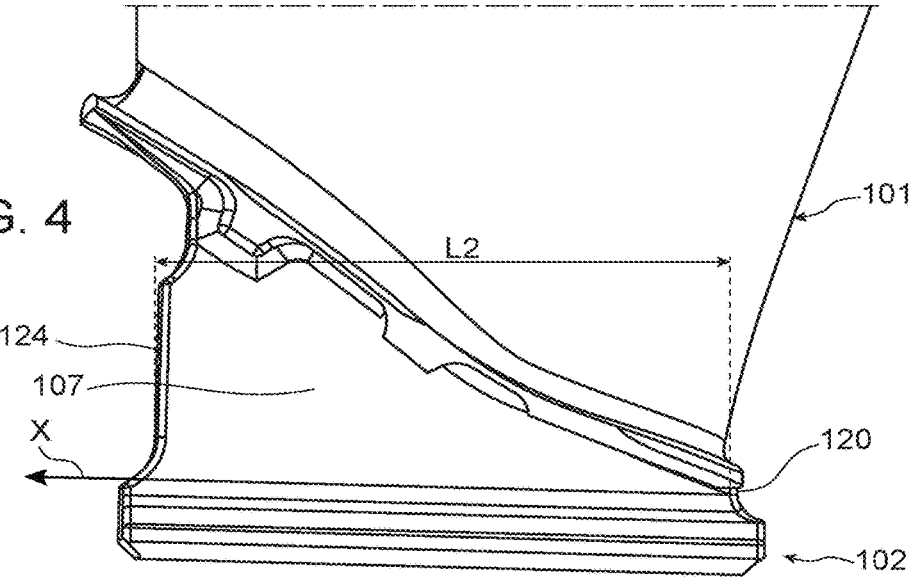

A particularly preferred embodiment of the invention is represented in FIGS. 3 and 4, which illustrate a blade to be disposed at the first stage in an inlet of a compressor in a turbojet machine. A part of the description of FIGS. 1 and 2 holds here, and the elements of this embodiment that correspond to similar elements of the foregoing embodiment will carry the same numerals with an increase of 100. They are the vane 101, foot 102, platform 104, bulb 105, shank 106, the flat main face (the suction side here) 107, the other main face (the pressure side here) 108, depressed portion 110, bottom 112 and edge 114. Hereunder we indicate some characteristics specific to this embodiment, or which particularly deserve to be mentioned.

The inner radius of the vane 101 steeply varies along the foot 102, and the shank 106 has a strongly trapezoidal shape, almost triangular here, the platform 104 being adjacent to the bulb 105 at a free edge 120 of the shank 106.

The depressed portion 110 has the greatest possible area, taking into account the dimensions of the shank 106 and the curvature of the edge 114. It is triangular here, and it is defined by three rectilinear sides 115, 116 and 118. The side 115 is parallel to the junction line 121 between the bulb 105 and the shank 106, and adjacent thereto. The side 116 is approximately parallel to the junction line 122 between the shank 106 and the platform 104 and not far therefrom; because of reinforcing bumpers 123 of the platform 104 that connect to the upper part of shank 106, a distance must nonetheless be kept between this junction line 122 and the side 116. It is generally advantageous that the distance D1 between the main sides 115 and 116 which are parallel to the junction lines 121 and 122, and the distance D2 between these junction lines, satisfy the ratio D1/D2>50% at least, and better D1/D2>66%. This relationship is valid for any line extending in the height direction R (corresponding to the radial direction of the blade when it is installed in the machine, from the foot 102 to the tip of the vane 101), and intersecting the main sides 115 and 116, that is for almost all the area of the depressed portion 110 (except the ends in the length direction X, at which it is limited by other sides and curved junctions), although both D1 and D2 vary in the length direction X. The third side 118 of the depressed portion 110 is parallel to the free end 124 of the shank 106, opposite to the other free end 120 in the length direction X of the foot 102, perpendicular to the height direction R and corresponding to a direction of insertion of the foot 102 into a groove of the disc. Here again, the main sides are connected by curvilinear transitions having a great radius, one of which joining the main sides 115 and 116 adjacent to the junction lines 121 and 122. In the present case in which the shank 106 becomes very low near one of the free ends 120, the dimension L1 of the depressed portion 110 in the length direction X must be reduced so that the juncture 125 keeps a sufficient radius; if the shank 106 has a more regular height, the depressed portion could have a quadrangular shape and a greater length L1 so that a ratio L1/L2, in which L2 is the distance between the free ends 120 and 124, could reach 50% or more, up to 80%. This ratio L1/L2 may be over 30%, preferably over 40%, in embodiments similar to FIGS. 3 and 4.

The great span of the depressed portion 10 or 110 in the height direction R is illustrated also by this ratio, which is advantageous complied with: D1max/L1>0.67, greater values being more preferred. D1max is the maximal dimension of the depressed portion 10 or 110 in the height direction R.

The depth of the depressed portion 110 in this embodiment conforms to the foregoing rules and may be 30% to 40% of the thickness of the shank 106.

It will be noticed (FIG. 5) that the junction line 121 between the bulb 105 and shank 106 does not comprise any depression but has a constant radius of curvature in cross-section, connecting to the surfaces of the bulb 105 and shank 106 with portions 126 and 127 tangent thereto, so that any sudden change of orientation or inclination is avoided, and no concavity is created, at this place.

The invention claimed is:

1. A blade comprising:

a vane; and a foot, the foot comprising successively, by moving away from the vane, a platform, a shank and a bulb, the shank being connected to the platform and to the bulb by junction lines, the shank comprising first and second main faces respectively directed in a suction side and a pressure side of the blade and parallel, wherein the first main face is substantially plane or curvilinear, and the second main face is provided with a depressed portion extending over a depth of at least 25% of a thickness of the shank between the first and second main faces, and the depressed portion is limited by two main sides respectively parallel to the junction lines, said main sides being separated, along each line in a height direction of the blade which extends from the bulb to a tip edge of the vane, by a distance D1 which is at least 50% of a distance D2 separating the junction lines.

2. The blade according to claim 1, wherein the depressed portion extends over at least 35% of the thickness of the shank.

3. The blade according to claim 1, wherein the depressed portion has a bottom that is substantially flat or curvilinear surrounded by a curved edge that connects to the bottom without forming an angle.

4. The blade according to claim 2, wherein the depressed portion has a bottom that is substantially flat or curvilinear surrounded by a curved edge that connects to the bottom without forming an angle.

5. The blade according to claim 1, wherein the depressed portion is limited by rectilinear sides joined by curvilinear transitions.

6. The blade according to claim 1, wherein said two main sides are separated by at least 66% of the distance separating the junction lines.

7. The blade according to claim 1, wherein the depressed portion has a maximal dimension D1max in said height direction superior to at least 0.67 times a maximal dimension in a length direction of the foot which is perpendicular to the height direction.

8. The blade according to claim 1, wherein the depressed portion spans at least 40% of a distance L2 between two opposite free edges of said second main face.

9. The blade according to claim 1, wherein the depressed portion spans at least 50% of a distance L2 between two opposite free edges of said second main face.

10. The blade according to claim 1, wherein the depressed portion is limited by three sides only including said two main sides, and transitions between said three sides, the transition between said two main sides being curvilinear with a constant radius of curvature, a third side of said three sides being parallel to a free edge of said second main face.

11. The blade according to claim 10, wherein the blade is a blade at a first stage of blades in a compressor.

12. The blade according to claim 1, wherein the shank connects to the bulb by a juncture having a constant radius of curvature and portions joined to the shank and the bulb and respectively tangent thereto.

* * * * *